US005388525A

United States Patent [19]

Bodkin

[11] Patent Number: 5,388,525

[45] Date of Patent: Feb. 14, 1995

[54] RAILWAY CAR RETARDER

[76] Inventor: W. Andrew Bodkin, 144 Walker Rd., Swampscott, Mass. 01907

[21] Appl. No.: 108,545

[22] Filed: Aug. 19, 1993

[51] Int. Cl.[6] ..... B61K 7/00

[52] U.S. Cl. ..... 104/26.2; 104/252; 188/62

[58] Field of Search ..... 104/249, 251, 252, 253, 104/259, 260, 262; 188/62, 38, 41, 43, 44, 45

[56] References Cited

U.S. PATENT DOCUMENTS

| | | | |
|---|---|---|---|
| 1,864,361 | 6/1932 | Livingston | 104/26.2 |
| 1,871,929 | 8/1932 | Varble et al. | 188/62 |
| 2,393,146 | 1/1946 | Clark | 188/62 |
| 2,904,133 | 9/1959 | Bodkin et al. | 188/62 |
| 3,974,776 | 8/1976 | DeIvernoise | 104/26.2 |
| 4,088,078 | 5/1978 | Noble | 104/26.2 |
| 4,125,177 | 11/1978 | Durraffourt | 104/26.2 |
| 4,867,279 | 9/1989 | Link et al. | 104/26.2 |

FOREIGN PATENT DOCUMENTS

| | | | |
|---|---|---|---|
| 2668441 | 4/1992 | France | 104/249 |
| 0033411 | 3/1979 | Japan | 104/26.2 |

*Primary Examiner*—Mark T. Le
*Attorney, Agent, or Firm*—John P. McGonagle

[57] ABSTRACT

An improved railway car retarder, fitted with fluid power cylinders, such as hydraulic or pneumatic cylinders. The cylinders function to temporarily release the force of retarder friction rails on train car wheels. The retardation function is still carried out by conventional spring assemblies and the functional integrity of existing retarders is not disrupted.

86 Claims, 14 Drawing Sheets

RAILWAY CAR RETARDER

BACKGROUND OF THE INVENTION

This invention relates to spring-loaded, inert railway car retarders, and more particularly to an improved retarder with release means.

The basic function of a fixed, spring-loaded, inert retarder is to offer a preset resistance to all railway cars entering into it. This is done with devices which are installed in a railway track in order to retard or to completely arrest the rolling movement of cars by pressing an auxiliary friction rail against the car wheels so that the latter are braked by friction. U.S. Pat. No. 2,904,133 "Railway Car Retarder" to John A. Bodkin, et al, best describes this type of retarder.

By their natures, inert retarders have a preset resistance which cannot be varied without a time consuming readjustment of the multiple fastenings that hold the retarder in place. Consequently cars caught in the retarder must be pulled through by a locomotive or other external source of comparable motive power causing wear and noise. In many industrial applications, however, the cars are positioned by a fixed car puller or small engine, which lacks the power to move cars through the retarder, thereby limiting its applicability.

Because of an inert retarder's fixed braking force, cars with different weights are slowed to different speeds. This presents a problem when the retarder is used in hump yards where cars must maintain a certain speed to negotiate turns, roll to the end of the track and couple without damage.

Another limitation experienced with conventional inert retarders is with the friction rails themselves. Retarder friction rails must be replaced periodically as they wear out. This is a time consuming operation that usually requires the dismantling of the entire retarder assembly.

SUMMARY OF THE INVENTION

In view of the foregoing disadvantages inherent in the known types of devices now present in the prior art, the present invention provides an improved railway car retarder. As such, the general purpose of the present invention, which will be described subsequently in greater detail, is to provide a new and improved railway car retarder which has means for releasing the retarder. The improvements enhance the performance of the retarder and extend the capacity of the retarder from that of a fixed, autonomic, passive or inert retarder, to one that can not only slow or stop free-rolling railway cars, but can also release them in a controlled manner. The improved retarder retains its original capacity to stop free-rolling cars, which can be pulled through it by a locomotive or other motive power, but can also be opened up to permit the passage of cars through it, unimpeded, minimizing retarded wear, expenditure of energy and noise pollution.

To attain this, the present invention provides an improved or conventional autonomic inert retarder, fitted with a powered release assembly. Although variations of fluid power and electromechanical mechanisms, pneumatics, hydraulics, electric, and/or motorized combustion engines may be used to provide this function, the present invention preferred embodiment is fitted with hydraulic fluid power cylinders. Unlike other automatic retarders, the release assembly of the present invention is not part of the retarding function.

In the present invention a power failure would not lead to loss in stopping ability and subsequent safety hazards. The hydraulic cylinders of the present invention embodiment function to temporarily release the force of retarder friction rails on train car wheels. The retardation function is still carried out by conventional spring assemblies and the functional integrity of existing retarders is not disrupted.

The problem of replacing retarder friction rails is addressed by replaceable face plates bolted to the friction rail. The head of the friction rail is planed down to be flat with the web of the rail and a length of steel bar or other friction material is bolted in its place. The bar becomes the wear piece, easily unbolted and replaced.

Referring particularly to U.S. Pat. No. 2,904,133, as an example of prior art inert retarders, the present invention contains other improvements over prior art inert railway car retarders. The retarders of the present invention are mounted on single continuous gauge plates that extend under the running rails on both sides of the track.

In the present invention there is a shoulder block at each end of the gauge plate that bears against the outside edge of the running rail base on each side and assists in preventing the gauge of the track from spreading. There is also a riser block at each end of the gauge plate that bears against the inside edge of the running rail and prevents movement of the rails inward or narrowing of the gauge of the track. "Inward" is hereinafter defined as being toward the center of the track bed. The retarder braking rails are mounted on these riser blocks, the height of which can be varied. The present invention is thereby useful for application in tracks of rails of different height and provides for variation in the elevation of the bearing surface of the friction rails against the backs of the car wheels. These improvements also serve to prevent derailment and, by increasing the frictional area, to dispel the heat of friction. Further, the riser blocks are undercut to provide a lip under which the flanges or foot plates of the brackets pass. This prevents the bracket from tipping backward under the force of the spring compression and assists in holding the bracket immovable.

The friction rail fitting on the inside of the friction rail has been improved by extending the lateral walls downward to bear on the surface of the gauge plates, on either side of the riser block, said lateral walls functioning as rail braces to prevent the braking rail from tipping inward under pressure from the car wheels.

The holes in the gauge plates are tapped to accommodate cap screws, to replace the prior art screw spikes that serve to hold down the brackets. These can be loosened and tightened as frequently as required to vary the adjustment of the retarders, without damage to the cross ties beneath the rail. Screw spikes are limited in their holding power by the fragility of the wood fibers into which they are threaded, and have limited application because of the breakdown of the fiber of the ties under repeated tightening and loosening.

The retarder is further improved by the addition of external guard rails, on the outside of the running rails. These are useful in preventing derailment of the cars in the retarder.

The prior art inert retarder calls for active (spring loaded) friction rails on both running rails. However, equivalent friction can be obtained if only one friction rail is spring loaded and the other is fastened securely to the track bed. This design affects the same retarding force with a significantly reduced number of components.

The single active rail inert retarder may also be used as a releasable automatic retarder. This can be done by fitting the active friction rail with hydraulic releasing cylinders. The fixed rail may also be fitted with an hydraulic releasing mechanism that would move the fixed rail closer to the active rail thereby removing the friction force.

The hydraulic release mechanism may be controlled in several ways. One way is to totally remove the retarder friction, thereby opening the track up for free train car passage. This is an "ON-OFF" operation. Another way is to partially release the friction rails, thereby allowing a train car to pass with reduced friction. A third way is to release the cradles sequentially, thereby allowing a car to advance with the release. These techniques can be used to control speed, or position the car.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
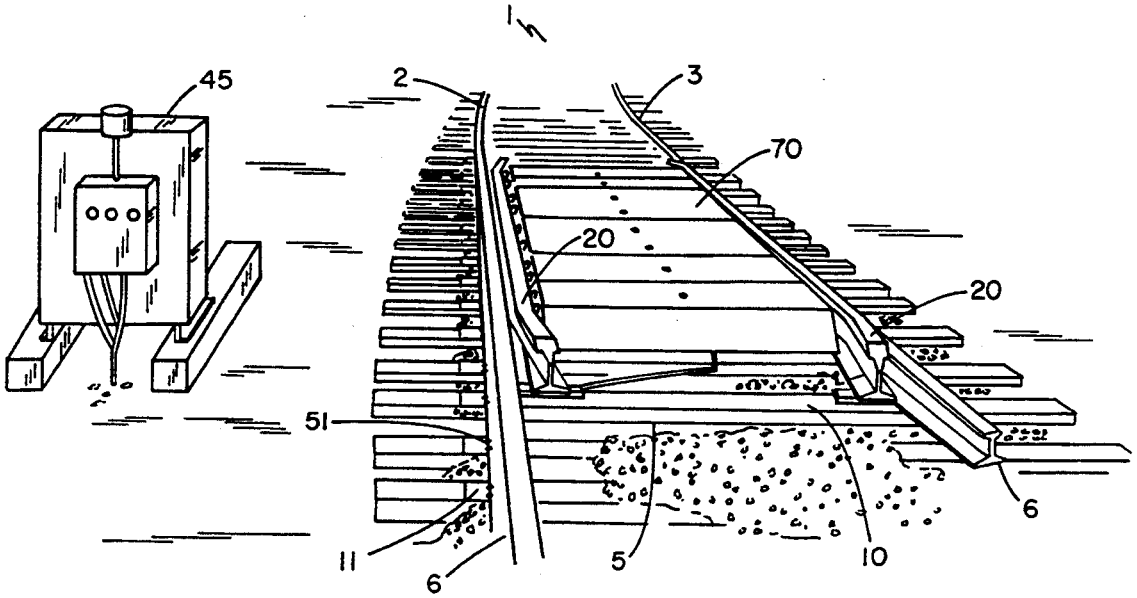
FIG. 1 is a perspective view of a railway car retarder constructed according to the principles of the present invention and installed in a track bed.
Figure 2:
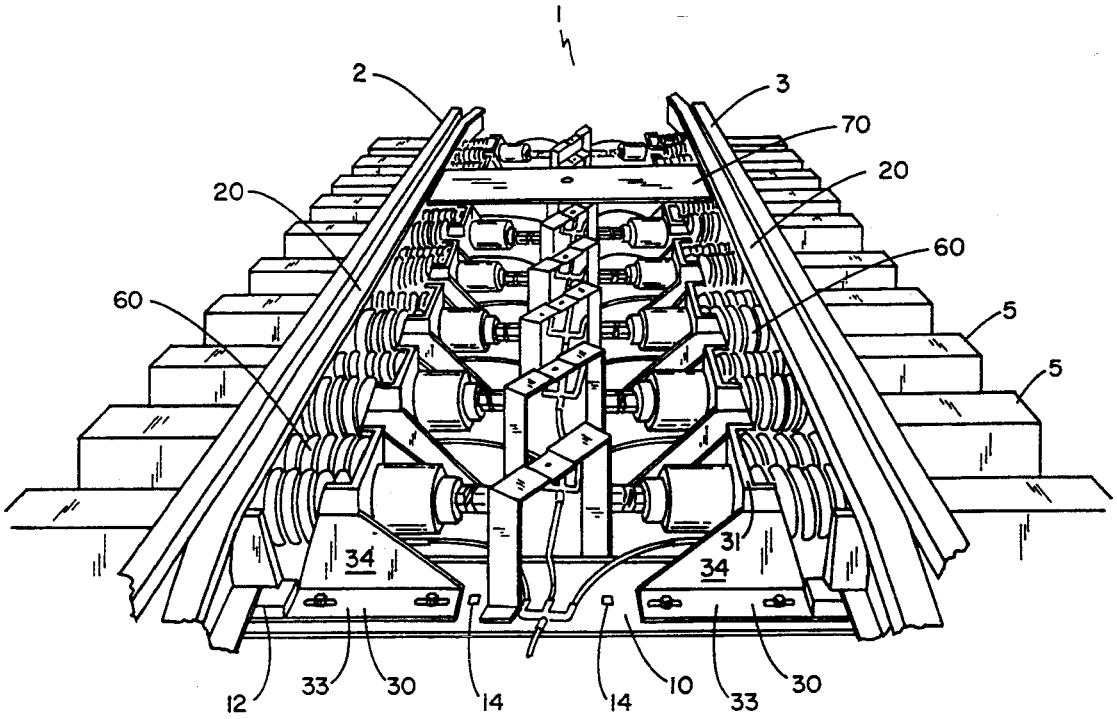
FIG. 2 is a close up view of the retarder of FIG. 2 with all but one section cover removed.

Referring to the drawings in detail wherein like elements are indicated by like numerals, there is shown a railway track 1 incorporating an improved railway car retarder. Reference numerals 2 and 3 indicate the left and right running rails of a normal railway track 1 which has ties 5 (usually wooden) underlying and crossing its rails 2, 3. A metallic gauge plate 10 overlies each of the ties 5 extending under the running rails 2, 3 on both sides of the track 1. The plates 10 are affixed to the ties 5 in known manner, for example, by spikes passing through holes 14 in the plates 10.

There is a shoulder block 11 at each end of the gauge plate 10 that bears against the outside edge 4 of the running rail base 6 of each rail 2, 3. The shoulder blocks 11 help prevent the gauge of the track, i.e., separation between left 2 and right 3 rails, from spreading. There is also a riser block 12 near to each end of each gauge plate 10 and positioned inside of each running rail 2, 3. Each riser block 12 bears against the inside edge 7 of the running rail 2 and 3 and prevents movement of the rails 2, 3 inward thereby preventing a narrowing of the gauge of the track 1.

A number of brackets 30 are arranged within the track 1. Each of these brackets 30 has an elongated part 31 extending in the direction of the track 1 over the space between two neighboring ties 5 and being recessed at the side opposite to the track center whereby the bracket 30 forms a housing 36 for the ends of springs which will be described later. Each bracket 30 has a ledge 32 extending from the bottom of the elongated part 31 toward the center of the track 1, two foot plates 33 extending to both sides horizontally, and vertical walls 34 reinforcing the connection of the parts 31, 32 and 33. Each bracket 30 also has a member 55 with a hole formed therein extending below the rail level.

The brackets 30 are arranged in pairs, each pair comprising two brackets extending between the same neighboring ties 5 at opposite sides from the track center line. The bracket foot plates 33 overlie the gauge plates 10 positioned on adjacent ties 5. The foot plates 33 have slots 35 formed therein. The gauge plates 10 have tapped holes 72 formed therein to accommodate cap screws 16 which pass through the slots 35 of the foot plates 33 and the tapped holes in the gauge plates 10. The slots 35 permit adjustment of the position of the brackets 30 when the cap screws 16 are loosened. These can be loosened and tightened as frequently as required to vary the adjustment of the retarders, without damage to the cross ties 5 beneath the rail.

Figure 3:
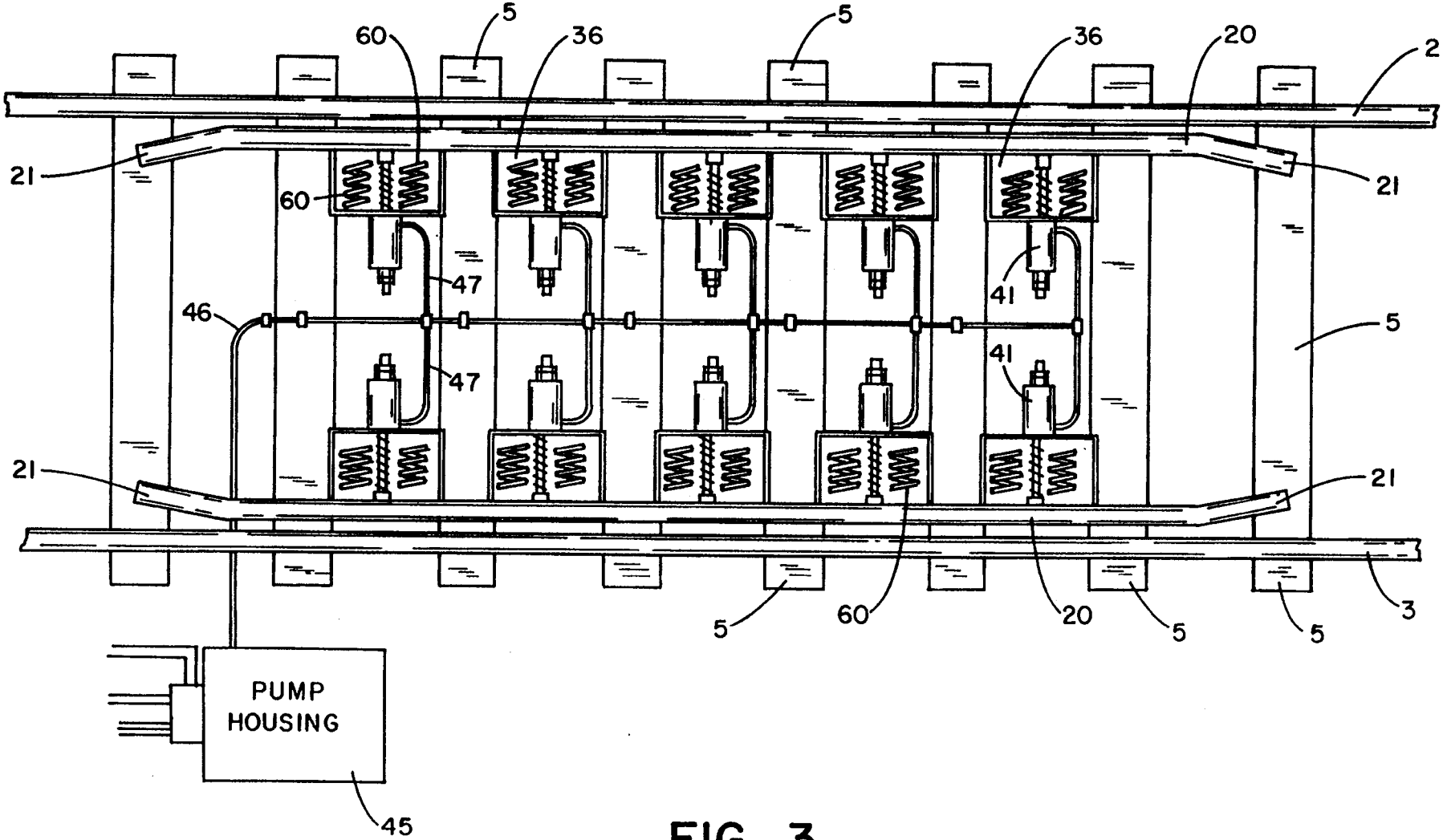
FIG. 3 is a schematic diagram of the retarder of FIG. 1, without section covers.
Figure 4:
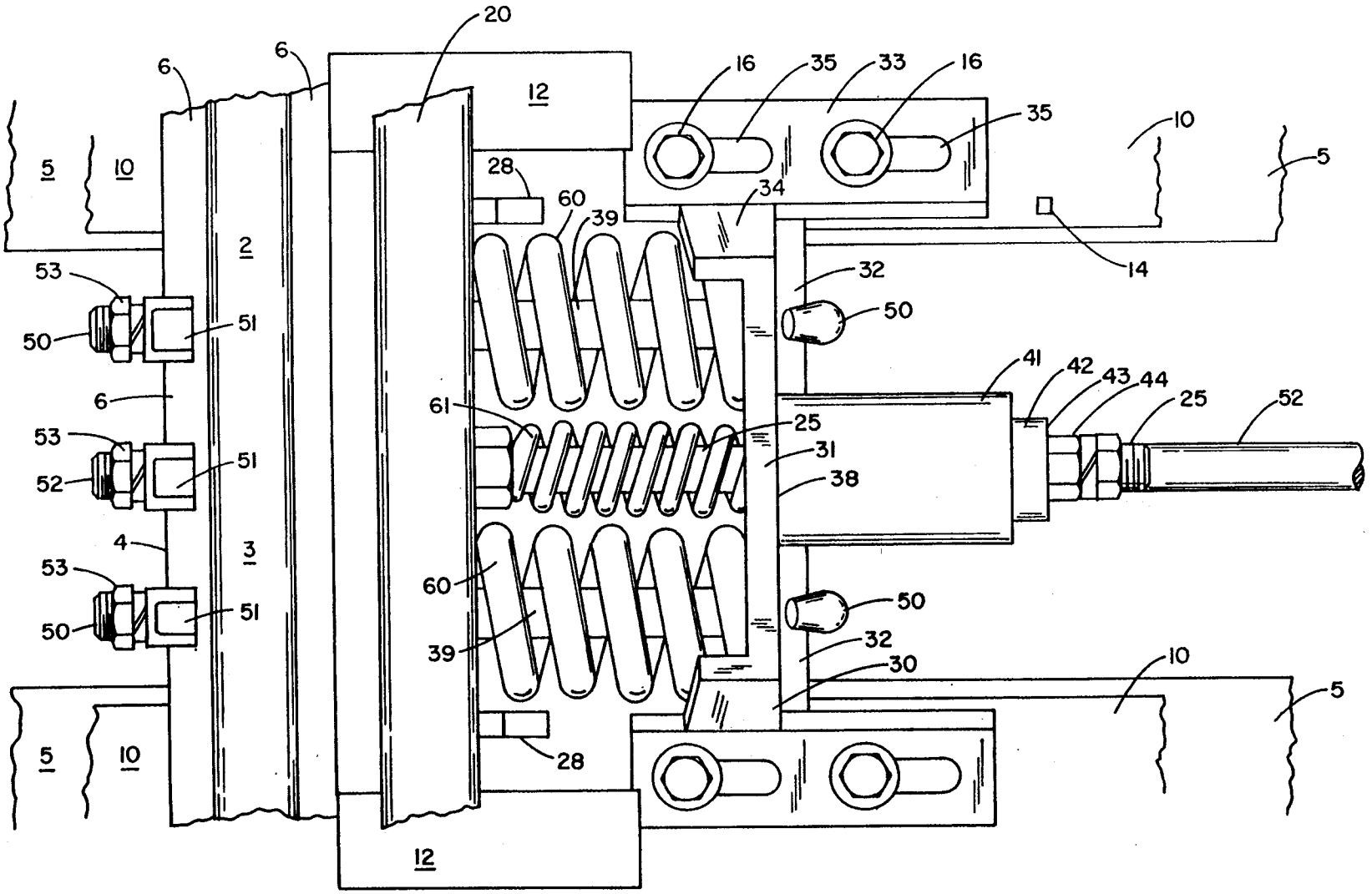
FIG. 4 is a top plan view of a portion of one retarder section from the retarder of FIG. 2.
Figure 5:
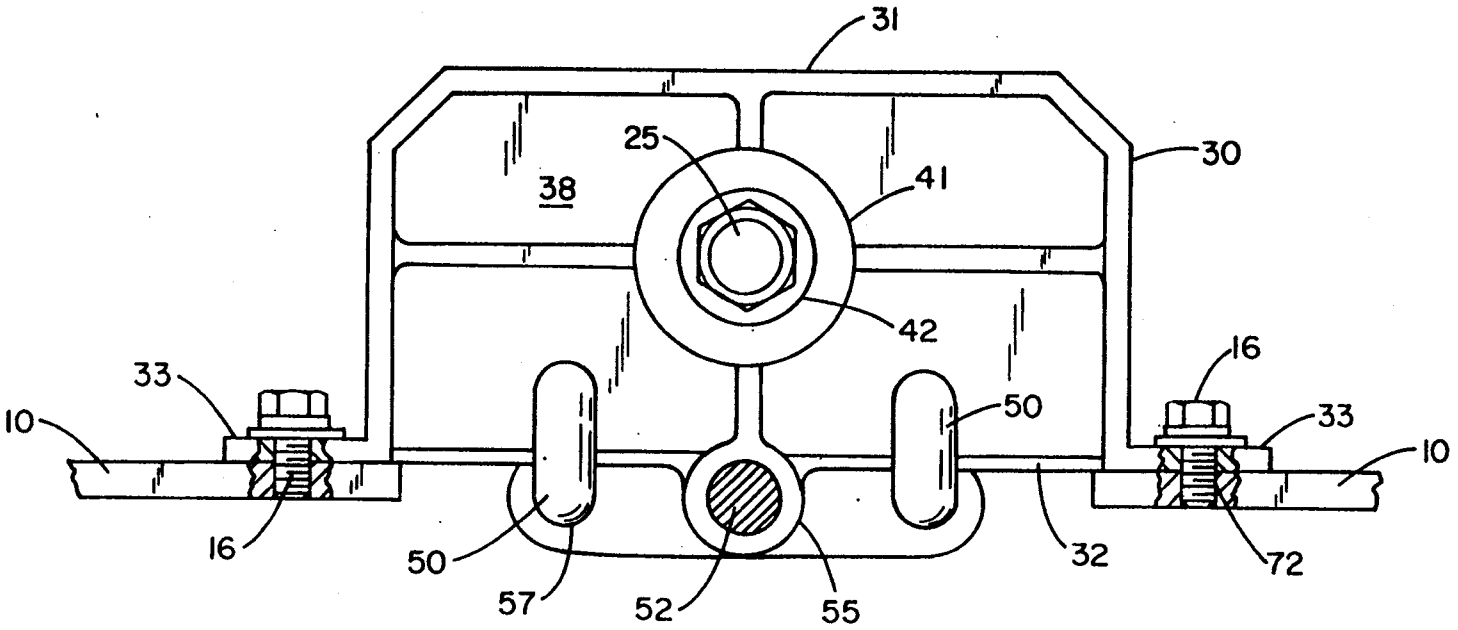
FIG. 5 is an end view of the retarder section of FIG. 4.
Figure 6:
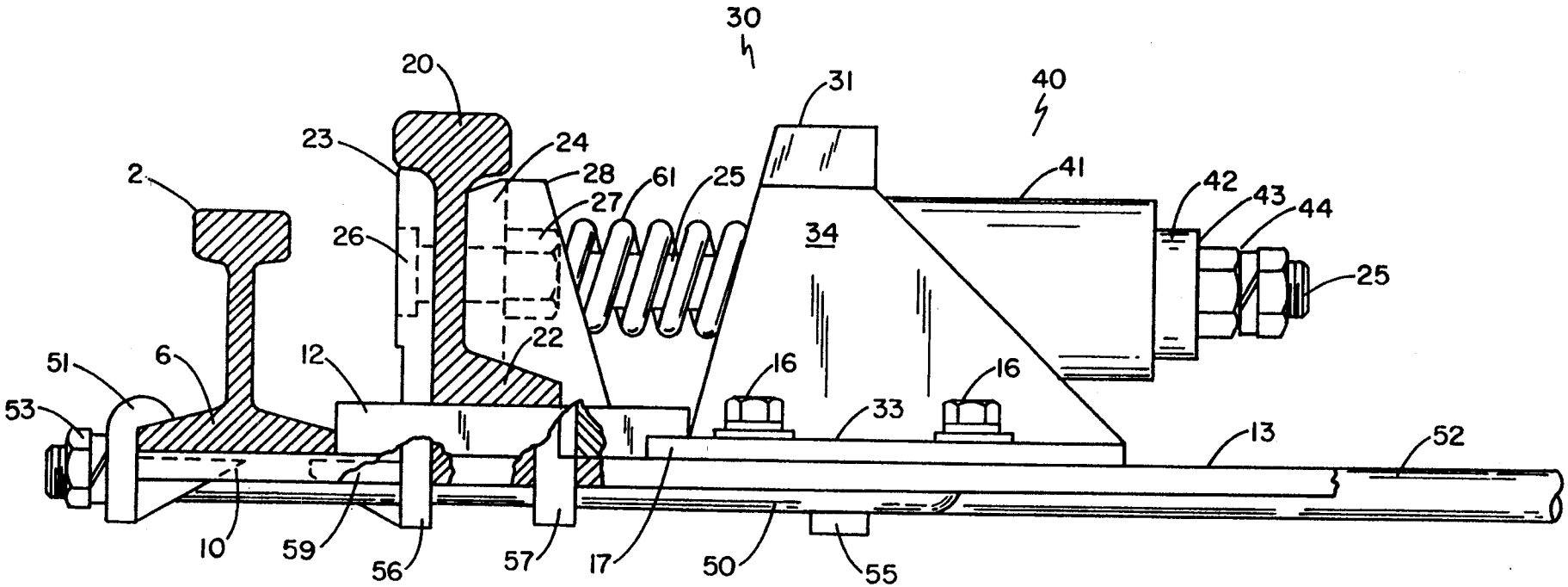
FIG. 6 is a side elevational view of a retarder section.

In actual use, there will normally be multiple pairs of brackets 30 used in a retarder assembly constructed according to the present invention. As is illustrated in FIG. 3, the multiple pairs are arranged symmetrically with respect to the longitudinal center line of the track 1. The brackets 30 form a left and right row, each row comprising one bracket of each pair.

Two auxiliary or friction rails 20 extend near the insides of the running rails 2, 3, one between the left rail 2 and the left row of brackets and one between the right run rail 3 and the right row of brackets. The friction rails 20 rest on the riser blocks 12 positioned inside of each running rail 2, 3. The ends 21 of the friction rails 20 are preferably bent inward toward the center of the track 1 in order to facilitate the entrance of car wheels into the space between run rails 2 or 3 and friction rails Each friction rail 20 has the outside portion of its foot 22 cut off. Fittings 23 and 24 are affixed on each side of the friction rail 20 by a screw bolt 25 passing through the fittings and friction rail, the screw bolt having a head 26 positioned in a recess of the outer fitting 23 and being tightened by a nut contacting the inner fitting 24. The same bolts 25 extend farther through the nearest bracket part 31. The inner friction rail fitting 24 has lateral walls 28 extending downward to bear on the surface 13 of the gauge plates 10, on either side of the riser block 12. The inner friction rail fitting lateral walls 28 function as rail braces to prevent the braking rail from tipping inward under the pressure from the car wheels 8. The fittings 24 each have three members 56, 57 with holes formed therein extending below the rail level. The outer fitting 23 also has two extended fingers 59 that fit under the adjacent running rail base 6. This helps prevent the friction rail from tipping when a car wheel 8 enters the retarder.

High strength springs are positioned between the brackets 30 and the friction rails 20. In the example shown, two coiled springs 60 of thick wires and large diameters are positioned between each bracket 30 and the nearest friction rail 20. Each spring 60 has an inner end reaching to and contacting the bracket part 31 and an outer end contacting the friction rail 20 and its inner fitting 24. The friction rail inner fitting lateral walls 28 also provide a recess for receiving the spring ends. There may be somewhat smaller further springs similarly located between bracket 30 and friction rail 20 within or beside the springs 60. In this embodiment of the invention, a spring 61 surrounds each bolt 25, and a spring (not shown) is nested within the coils of each spring 60.

The springs 60 and 61 exert a pressure which tends to move a friction rail 20 outward toward its related running rail 2 or 3. The brackets 30 are secured against dislocation from the spring pressure by their previously described connection with the ties 5 and additionally by clamping devices which comprise: hooked rod members 50 gripping the bracket ledges 32; jaw members 51 gripping the outside edge 4 of the running rail base 6 of each rail 2, 3; hook rods 50 passing through the bores of the members 56, 57 and 51; and nuts 53 screwed on the ends of the hook rod members 50 and holding the jaw members 51 in gripping positions with the hook end of the rods. The rails 2, 3 are further secured from gauge widening by gauge rods 52 that runs between jaw members 51, and through bores of the members 55, 56, 57. The gauge rods 52 are used to clamp the left running rail 2 to the right running rail 3. Each gauge rod 52 passes through the bracket assembly member 55 of the left and right running rails 2, 3. When the car wheels 8 enter the space between the running rails and friction rails 2, 20 and 3, 20, the car wheels 8 crowd the friction rails 20 and force them to slide inwardly toward the center of the track 1 against the pressure of the springs 60, 61. The resulting spring pressure of each set of springs on both sides of the track exerts a counter force back through the friction rails 20 against the car wheels 8 thereby braking the car. The inward lip 17 of the riser block 12 serves to capture the outer edge of the foot plates 33, securing the bracket 30 against tipping inward under the force of springs 60, 61.

The friction rails 20 are fitted with stop bolts 19 and web fittings 18. The end of the stop bolt is in contact with the running rail 2, 3, and limits the movement of the friction rail 20 towards the running rail 2 or 3. This is of importance when the train wheel 8 passes through the retarder, causing the friction rails 20 and retarder springs to compress and push back against the train wheel. The stop bolts 19 prevent the friction rail 20 from moving into and over crowding the wheel flange 9 space. The stop bolts 19 are also of use in jacking the retarder out when making adjustments.

The present invention also provides a means for releasing the spring pressure of the friction rails 20. Two methods for releasing the spring pressure of the friction rails by hydraulic means are provided. One method for releasing the spring pressure on the friction rails 20 provides for a separate hydraulic release 40 for each spring nest, that is, all of the components attached to the friction rail 20 by one spring bolt 25 and one bracket 30, without direct mechanical linkage to the opposed friction rail or other retarder components. The friction rails 20 are pulled inward, compressing the springs 60, 61, by hydraulic cylinders 41 mounted separately on each of the brackets 30. The hydraulic cylinders 41 are connected to each bracket 30 to act directly on the nested springs 60, 61. A direct mechanical connection is used that puts as few components as possible under stress. The cylinders 41 do not impinge on the regular action of the retarder, allowing free movement of the center spring bolts 25 during inert operation of the retarder. This is also preferred for in the event of power loss the retarder remains an operational inert retarder in the safety closed state, preventing runaway cars.

The cylinders 41 are hollow. The spring bolt 25 that attaches to the friction rail 20, passes through a hollow core piston 42 and is constrained at its inner end 43 by lock nuts 44. When hydraulic fluid forces the piston 42 inward the spring bolt 25 moves with it, pulling the friction rail 20 inward. The cylinder 41 works against the back 38 of the bracket elongated part 31 which is bolted to the gauge plates 10 through the foot plates 33 which pass under the riser block inward lip 17 and are locked by a lock pin 15 passing through holes in the lip 17 and underlying plate 10. Hydraulic fluid is distributed from a pump 45 via a pipe manifold 46 and flexible hoses 47 to each cylinder 41. Pressure feedback from the springs 60 indicates full retraction to a pressure switch (not shown) in the fluid system, shutting off the pump 45 and locking the cylinders with valves (not shown).

A feature of this method is that the spring bolts 25 move freely through the hollow piston 42 of the hydraulic cylinder 41, so that there is a mechanical break or discontinuity between the inert, mechanical retarding components and the hydraulic release 40, which permits mechanical retardation without hydraulic impedance and consequently, without stressing the cylinder 41.

Figure 7:
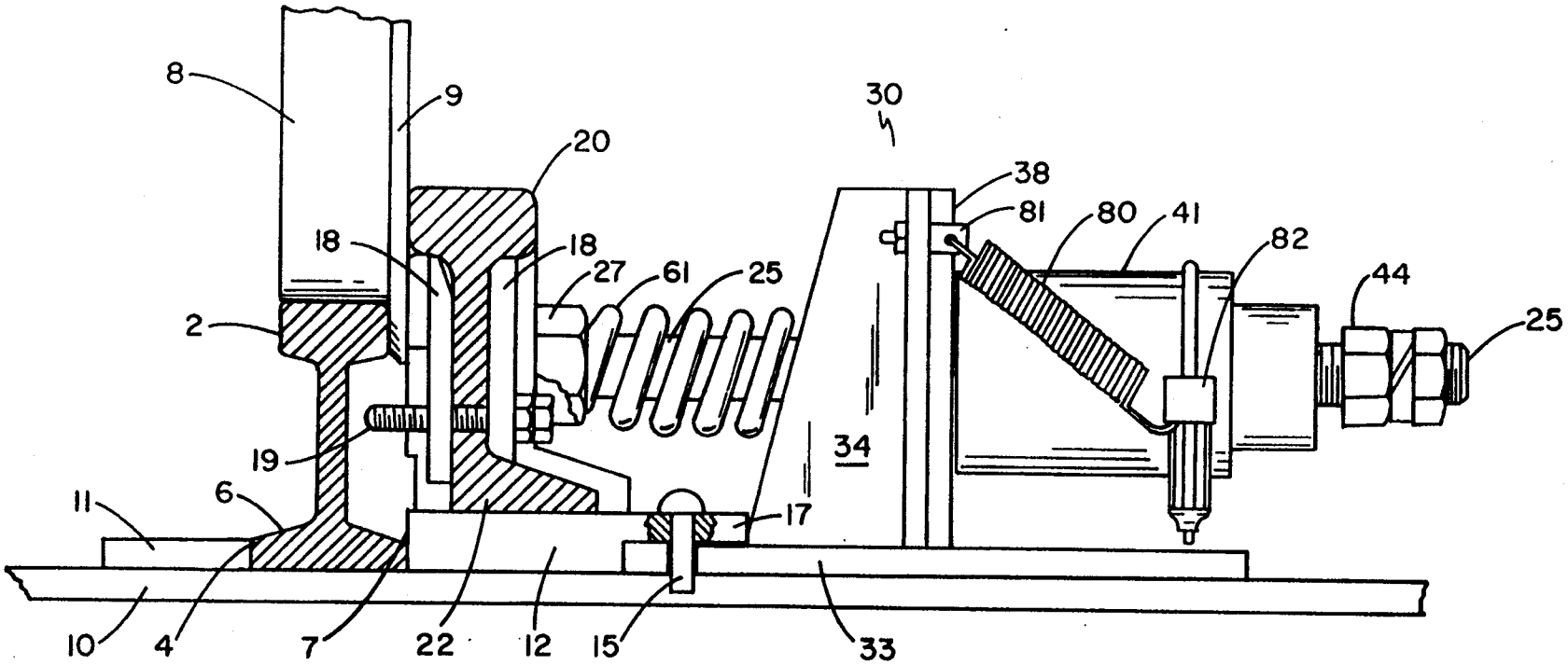
FIG. 7 is a schematic side elevational view of a retarder section, partly in cross-section.
Figure 8:
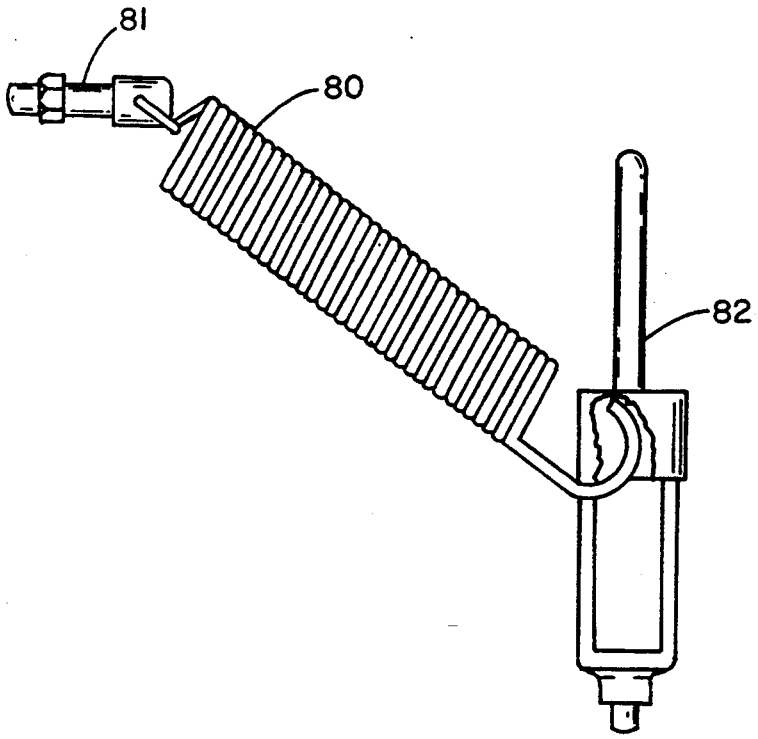
FIG. 8 is a close up view of the spring clamp of FIG. 7.

Another unique feature of this method is the cylinder mounting. See FIGS. 7 and 8. The cylinder 41 is mounted onto the spring bolt or pull rod 25, that has been lengthened to accommodate it. The hollow cylinder 41 is slid over the pull rod 25 and abuts the back 38 of the bracket 30. The action of the rod 25, when a car wheel 8 enters the retarder, is to move through the bracket 30 towards the center of the track. Additionally it tends to tilt downwards towards the ground. It is because of this downward motion that a unique mounting for the cylinder 41 was developed. The cylinder 41 is suspended by two springs 80 attached to bolts 81 affixed to the back 38 of the bracket 30. A clamp 82 is positioned about the hydraulic cylinder 41. The free end of each spring 80 is attached to opposite sides of the clamp 82. This provides a firm but flexible suspension which supports the weight of the cylinder 41 and accommodates the downward thrust of the rod 25 through the hollow piston 42, thereby minimizing frictional wear between the bolt 25 and cylinder 41.

The hydraulic cylinders 41 are protected from the environment by a cover 70 over the retarder assembly, spanning the space between the friction rails 20. The pump 45 is mounted on ties adjacent to the retarder in a weather proof housing.

Hydraulic release pump and control apparatus would usually be located adjacent to the retarder unit in a track 1. The apparatus could be equipped with safety flashers and a siren to keep personnel off of the retarder unit when energized. The retarder friction rail 20 to running rail 2, 3 gap snaps shut when the retarder release mechanism 40 is de-energized. The retarder pump 45 works on feed back pressure, to keep the unit energized. Stop rods 39 may be positioned inside the large nested springs 60 to cause pressure to suddenly spike when the hydraulic release 40 reaches the end of its stroke. This spike is used to signal the pumps and valves that the retarder is released and to stop pumping.

Figure 12:
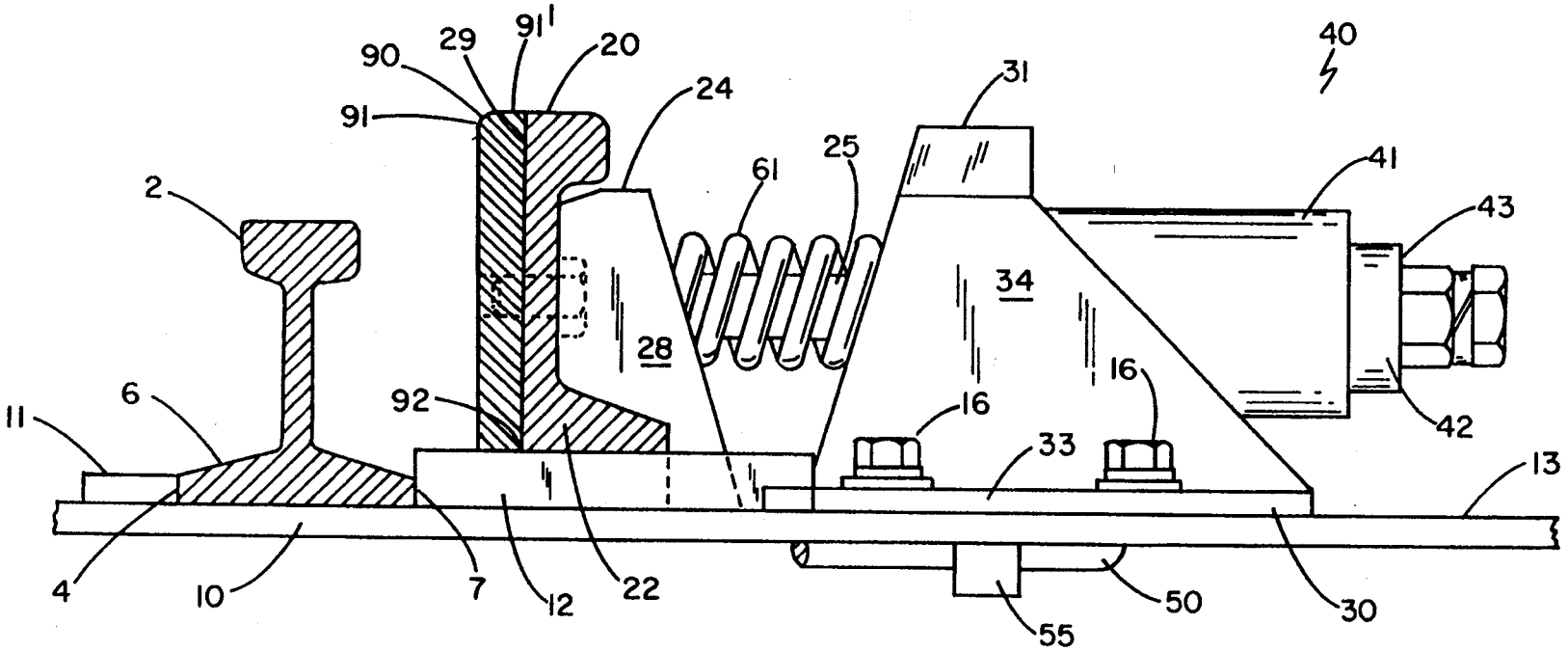
FIG. 12 is a side elevational view of a retarder section with a wear bar.

The problem of replacing retarder friction rails 20 is addressed by replaceable face plates 90 bolted to each friction rail 20. See FIG. 12. The outer side of the head 29 of the friction rail 20 is planed down on one side to be flat with the web of the rail 20 and a length of steel bar 90, or other friction material, bolted in its place. The bar 90 becomes the wear piece, easily unbolted and replaced. After a time, the car wheels 8 will wear the upper outside longitudinal corner 91 of the wear bar 90. The bar 90 can then be simply unbolted, inverted and reversed, thereby presenting a new longitudinal corner 92 to the car wheels 8, or just reversed to present the opposite top corner 91' to the car wheels 8.

Figures 9A, 9B:
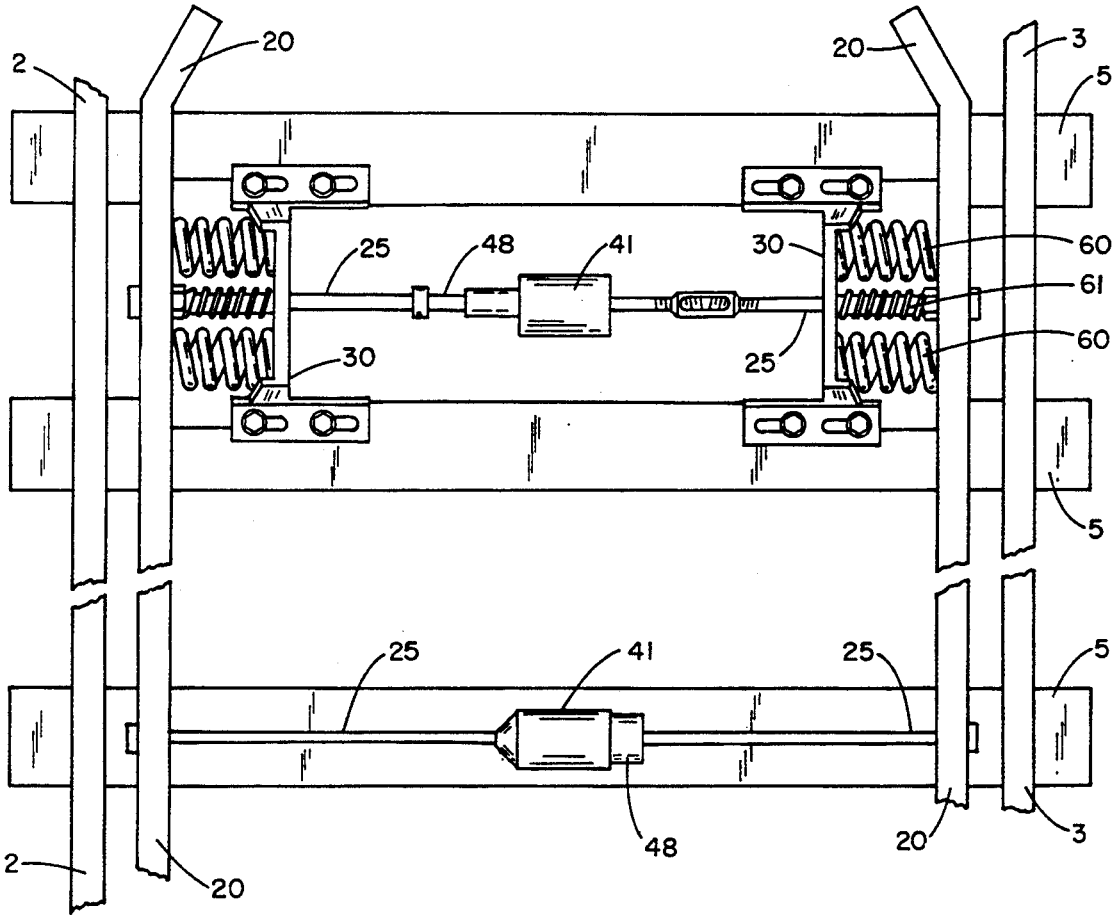
FIG. 9A is a top plan view of a retarder section with hydraulics interconnecting friction rails with slack coupling and positioned between center bolt ends.
FIG. 9B is a top plan view of a retarder section with hydraulics interconnecting friction rails with slack coupling and positioned over ties.

A second method provides for a direct mechanical linkage between the opposed friction rails 20, either through spring bolts or other attachments, within which is interposed a retracting hydraulic cylinder 41. There are two embodiments illustrated, one (FIG. 9A) with the cylinder 41 interconnecting opposing spring bolts, and the other (FIG. 9B) with the cylinder 41 fitted between cradles over ties 5. When the cylinder 41 retracts it reduces the length of the linkage 25, pulling the opposite friction rails 20 inward, toward each other, further compressing the springs 60, 61 and thus relieving the pressure of the friction rails against the car wheels, allowing free car movement. Basic to this design is a slip joint 48, or equivalent, also interposed in the mechanical linkage 25, which permits the retarder to function as an inert retarder, using its spring resistance to stop cars, without impedance from the hydraulic units. The slip joint 48 functions like a chain, effective in transmitting hydraulic power to pull the friction rails 20 inward but falling slack when pushed by the inward movement of the friction rails. Thus, the friction rails 20 can move inward without effect on the hydraulic cylinders 41 which are therefore relieved of unnecessary movement and consequent stress and wear. With a direct mechanical linkage between the opposed friction rails, a rack and pinion arrangement may also be used.

Inert retarder technology usually calls for active (spring loaded) friction rails on both running rails. However, equivalent friction can be obtained if only one friction rail is spring loaded and the other is fastened securely to the track bed. This can be done with or without hydraulic controls. This design affects the same retarding force with a significantly reduced number of components.

Figure 10:
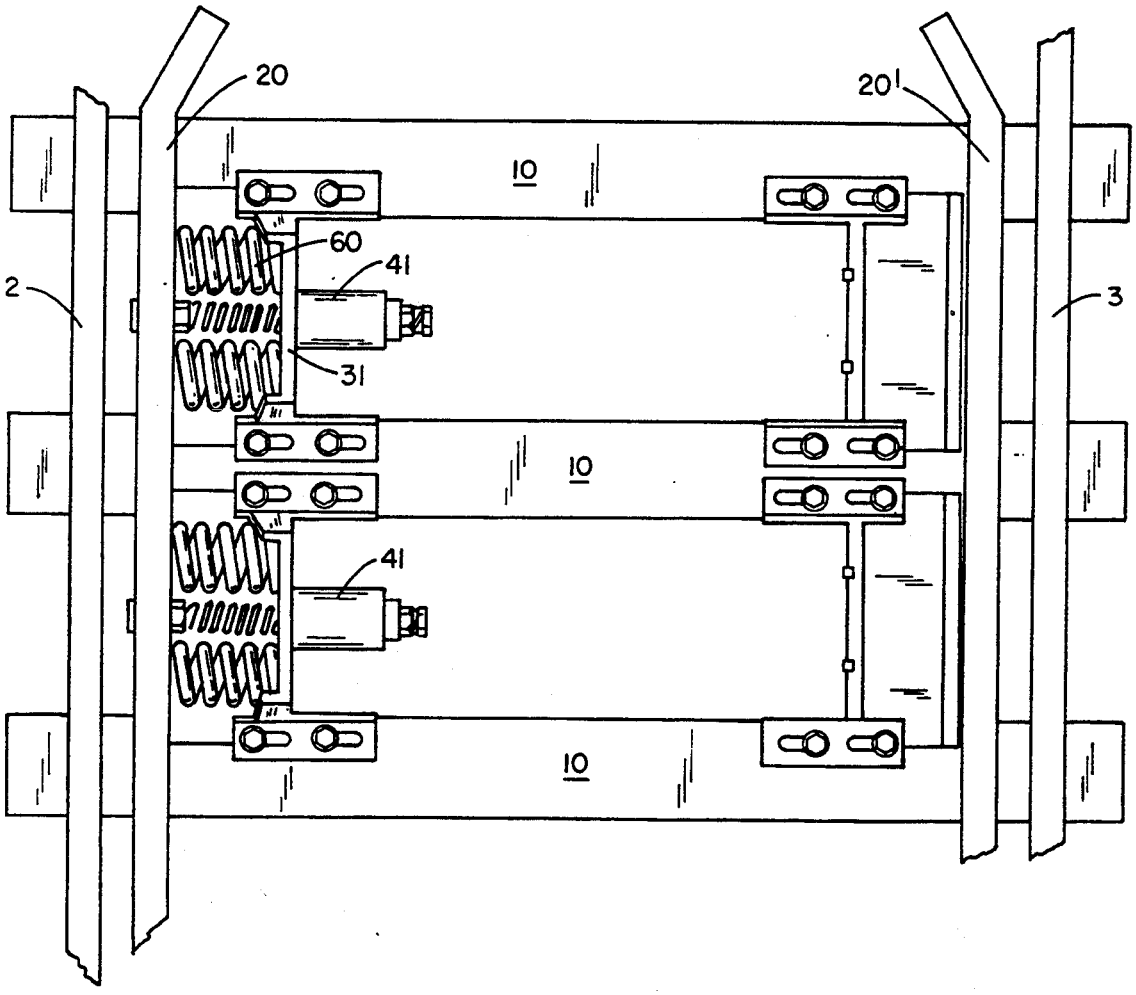
FIG. 10 is a top plan view of a retarder section configured as a single active rail retarder.
Figure 11A:
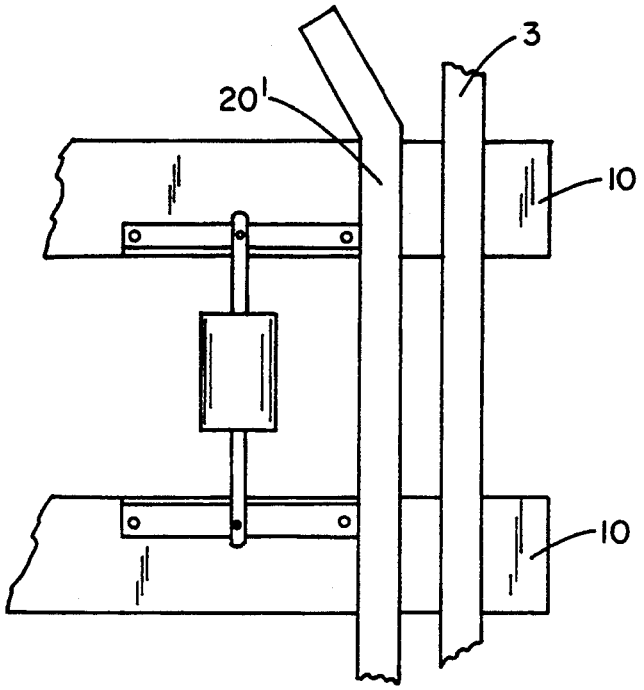
FIG. 11A is a top plan view of a horizontal release cylinder configured on the non-spring loaded rail of FIG. 10.
Figure 11B:
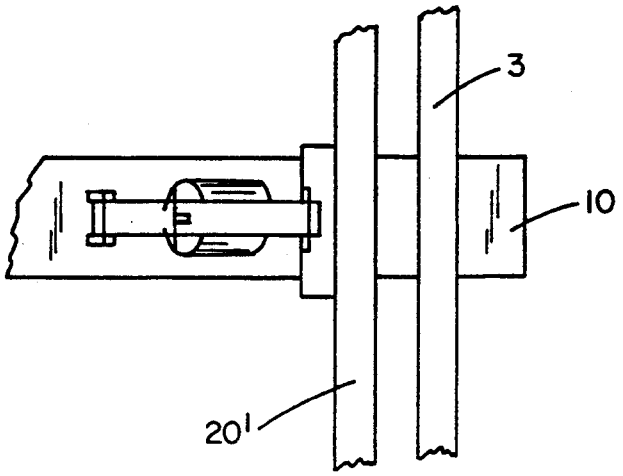
FIG. 11B is a top plan view of a vertical release cylinder configured on the non-spring loaded rail of FIG. 10.

In the preferred embodiment of the single active rail inert retarder, illustrated in FIG. 10, the retarder is configured as a releasable automatic retarder. This is done by fitting the active friction rail 20 with hydraulic releasing cylinders 41. The fixed rail 20' may also be fitted with an hydraulic releasing mechanism that would move the fixed rail closer to the active rail thereby removing the friction force. In an alternate embodiment, a release cylinder is fitted onto the non-spring loaded rail, either in a horizontal arrangement (FIG. 11A) or in a vertical arrangement (FIG. 11B). The chief difference in this alternate embodiment is that the hydraulics are fitted onto the inactive rail 20'. The advantage of this arrangement is that less force is required from the cylinder to effect release, thus allowing lower force cylinders to be used.

The hydraulic release feature in any embodiment of the present invention can be adapted to electronic controls, linking its functions to car speed and spacing or other car handling requirements. The retarder of the present invention may be operated in the stop and release mode. That is the retarder functions to stop or slow a passing car as a prior art inert retarder would. The present invention release 40 would be activated when it is desired to open the line to allow free passage of cars through the retarder. This may be done to release a captured car, or to pass a free rolling car or train of cars and engines unimpeded. The control of this function may be a simple on/off switch located at the track side, in the engine, in a remote control room, or a more sophisticated controller that is linked to other train car handling operations.

Mechanical and/or electromagnetic sensors can be used to operate the retarder release 40. Sensors located in the track bed or along side the track can be used to determine car position and velocity. This information is used to control the retarder release 40. Control schemes include automatic car-velocity control, position control, as well as manual intervention through a remote control panel, in which the retarder can be opened and closed as an operation in a man operated procedure.

The retarder of the present invention may be operated with proportional control. Proportional control is a speed control application for the retarder. By varying the pressure in the hydraulic release the normal force between the friction rails and the car wheel can be controlled. The normal force controls the energy absorbed by the retarder and hence the amount of braking action. The car velocity is sensed and used to operate the release. Weight may also be sensed so that momentum and energy are used as the controlling parameter for the proportional release.

The retarder may be operated in a pulsed mode, i.e., "Bang Bang" control. The retarder is pulsed on and off as a unit to control car speed. The duty cycle or average amount of time on is related to breaking power. Speed and/or weight may be sensed to operate control. In a simplified speed control application, a velocity sensor, such as radar, within the retarder may be used to trigger the retarder to release when the car entering the retarder has slowed to a preset speed.

The retarder may also be operated in a sequential, i.e., "snake", control. By fitting the manifold with valves for each cradle or opposing cradle set, the retarder cradles can be released sequentially. If the wheel is located in the retarder at a released cradle, there will be no frictional force or breaking action at that position. The wheel will move ahead unimpeded. If the next cradle is unreleased when the wheel arrives there, it will meet frictional resistance and the forward motion of the car will be reduced. If at this next position the retarded cradle is released, then the wheel will proceed unimpeded. If the single cradle released is advanced along the retarder, then the car wheel can be made to advance along at the same rate via the snaking action of the retarder friction rail. This assumes that the train car has sufficient momentum or gravitational impetus to carry it ahead. This type of control may use a series of position sensors along the retarder to place the released cradle at the wheel position. A continuous position sensor may be used, such as a radar or optical ranger. This control has the advantages of exactly positioning the car in time and place independent of initial entering velocity and momentum.

Controllable release retarders may be of particular use in multi-element car loading and unloading, or cleaning processes. It may also be used to advance a car through a sloped yard in a controlled and safe manner. It may also be used to couple up cars at a set speed to avoid coupler damage or shock to contents. If linked to weight sensors, it can control momentum of car and subsequent impact damage.

Figure 13:
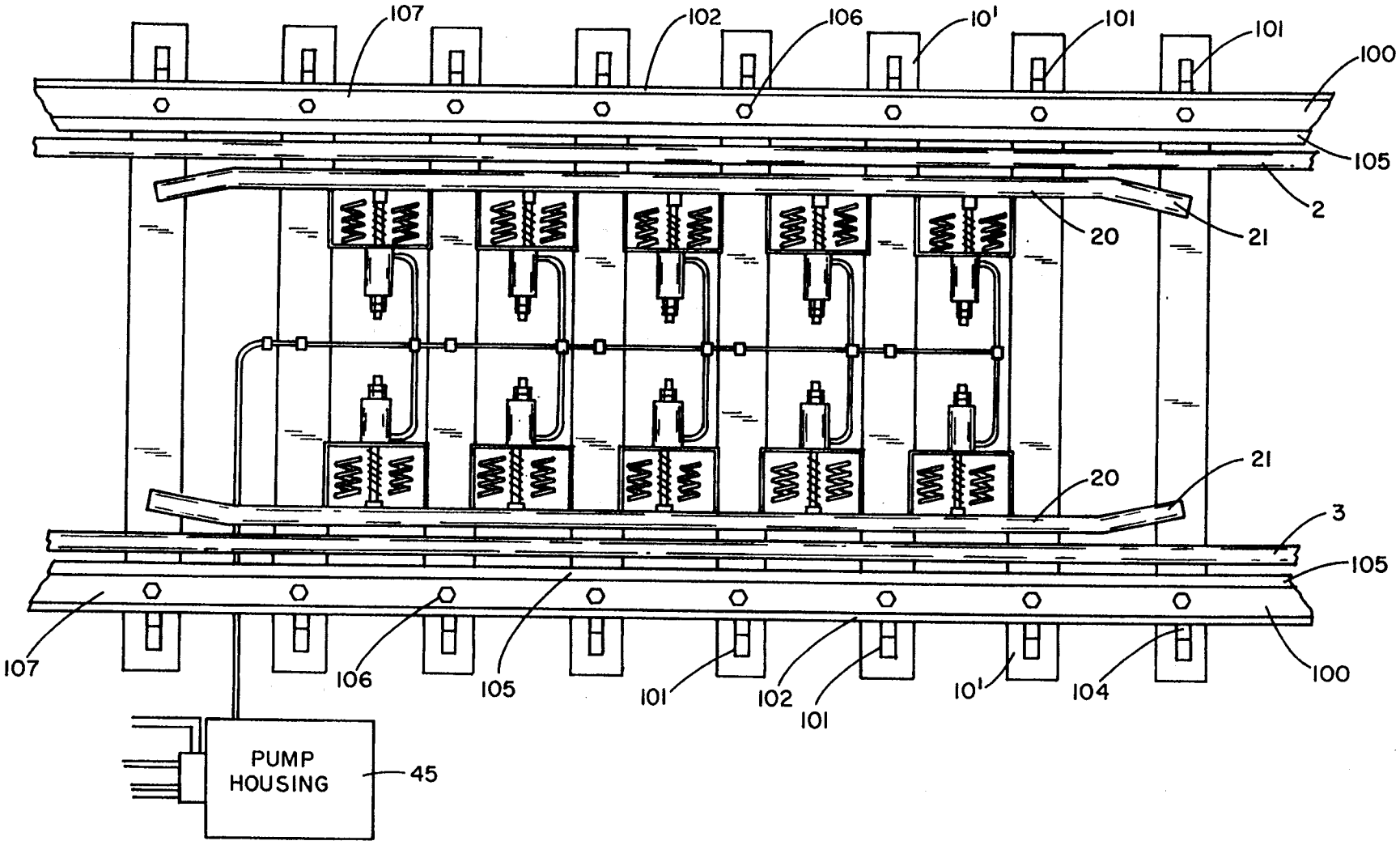
FIG. 13 is a schematic diagram of the retarder shown in FIG. 3 with external guard rails.
Figure 14:
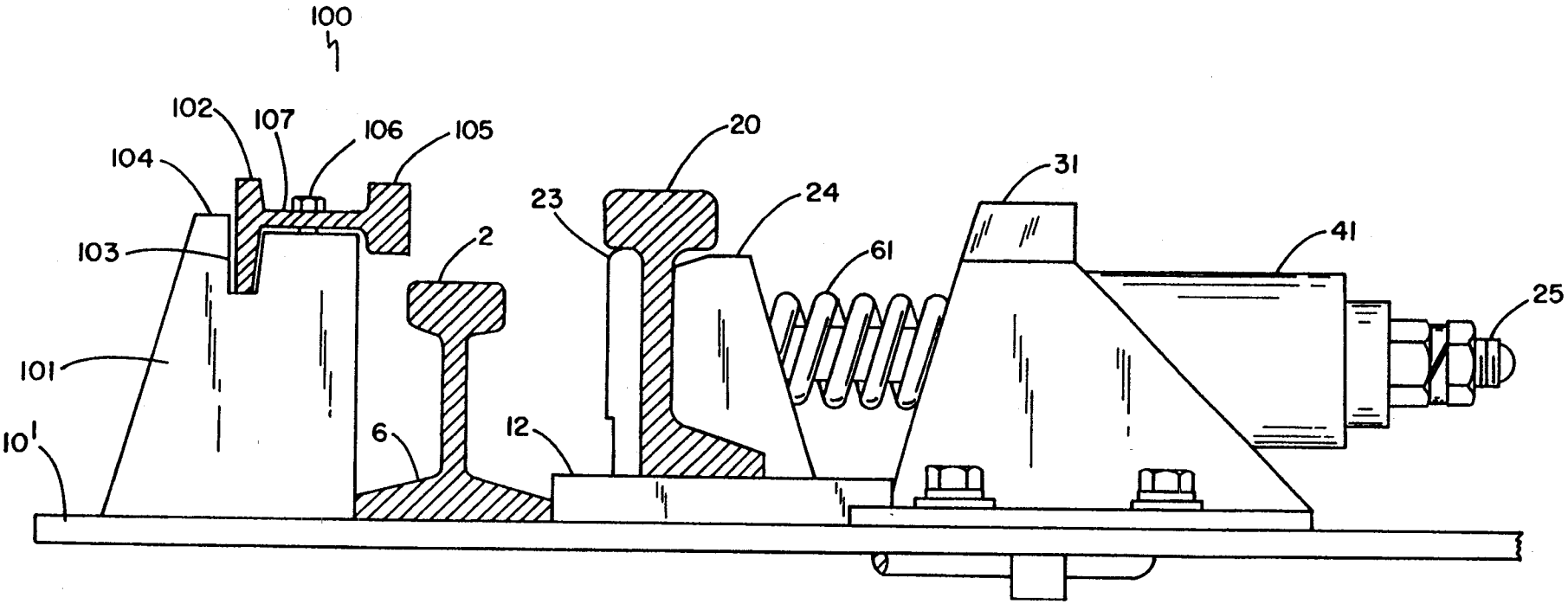
FIG. 14 is a side elevational view of the retarder section shown in FIG. 6 with external guard rails.

Because of the substantial forces involved in retarding railway cars, external guard rails 100 may be required on each side of a retarder assembly to prevent derailment during the retarder braking action. FIGS. 13 and 14 best illustrate the guard rails 100. In this embodiment, the gauge plates 10 are modified (10') by eliminating the shoulder blocks 11 of prior embodiments and welding guard rail braces 101 directly to the gauge plates 10' outside of both running rails 2, 3. The braces 101 are adapted to hold a running rail (guard rail 100) so that the rail 100 lies in a generally horizontal plane. One side of the guard rail base 102 is inserted into a slit 103 formed in the top 104 of the brace 101 parallel to the running rails 2, 3. Each guard rail top 105 is positioned above and outside the top of the adjacent running rail 2, 3. A cap screw 106 is bolted through the guard rail web 107 into the brace top 104. The external guard rail 100 of this embodiment may be used for both inert and releasable retarders.

It is understood that the above-described embodiments are merely illustrative of the application. Other embodiments may be readily devised by those skilled in the art which will embody the principles of the invention and fall within the spirit and scope thereof.

I claim:

1. An improved car retarder assembly for a railway track with a center line and having ties and a pair of parallel running rails, each rail having a base, an inside edge facing the opposite running rail and an outside edge facing away from the opposite running rail, said retarder comprising:

a metallic gauge plate overlying and permanently affixed to each of the ties, said plate extending under the running rails on both sides of the track;

two riser blocks positioned to bear against the inside edge of the running rail base and fixedly attached to one of said gauge plates, each said riser block having an inward lip;

a plurality of brackets arranged in pairs, each pair comprising two brackets extending between a pair of neighboring ties, at opposite sides of the track center line, each of said brackets having foot plates overlying neighboring gauge plates and each foot plate having holes, each of said brackets having an elongated part with a back facing said track center line, said elongated part extending in secured position parallel to said running rails, said elongated part, having a top and a bottom, extending over a space between two neighboring ties and being recessed at the side opposite to the track center whereby the bracket forms a housing, a ledge extending from the bottom of the elongated part toward the track center line, two vertical sides, and said foot plates extending horizontally to both sides away from said vertical walls, said gauge plates having tapped holes formed therein to accommodate cap screws which pass through the holes of the foot plates and the tapped holes in the gauge plates;

a plurality of cap screws passing through said holes in said foot plates and into tapped holes in said gauge plates to secure said brackets to said gauge plates;

a pair of friction rails each having an outside portion of its foot cut off and each overlying and slidably resting on said riser blocks within the pair of running rails, one rail of the pair of friction rails extending parallel to the elongated part of one bracket of said bracket pair, and between the one bracket and one of the running rails, and the other rail of the pair of friction rails extending parallel to the elongated part of the other bracket of said bracket pair, and between the other bracket and the other rail of the running rails, said friction rails each further including fittings affixed on two sides of said friction rail by a spring bolt passing through the fittings and friction rail, the spring bolt having a head positioned in a recess of the fitting on one side of the friction rail and being tightened by a nut contacting the fitting on the other side of the friction rail, said bolt extending farther through a nearest one of said brackets;

spring means engaging each friction rail and an adjacent one of said brackets to yieldably urge the friction rail to slide toward an adjacent one of the running rails;

connecting means between each bracket and an adjacent one of the friction rails to limit the movement of the adjacent friction rail toward an adjacent one of the running rails;

a hooked rod member attached by an adjustable nut to the base of one of said running rails, said rod member running underneath the friction rail and the bracket adjacent to said one of said running rails and underneath said one of said running rails and terminating in a hook member to grip an edge of said ledge of the adjacent bracket;

two shoulder blocks fixedly attached at and to the ends of one of said gauge plates and bearing against the outside edges of the running rail bases;

wherein, said friction rails are fitted with stop bolts and web fittings, said stop bolts each having an end in contact with an adjacent one of the running rails, thereby limiting the movement of the friction rail towards the adjacent running rail.

2. A car retarder as recited in claim 1 further comprising:

an external guard rail assembly positioned adjacent the outside edge of each running rail.

3. A car retarder as recited in claim 2 wherein each said external guard rail assembly is comprised of:

two sets of braces fixedly attached at and to each end of a gauge plate and bearing against the outside edge of the running rail base on each side, said braces having a top with a slit formed therein parallel to the running rails, each said set being positioned outside a running rail;

two guard rails, each with a web, a top and a base with two sides, and each of which positioned in a generally horizontal plane, parallel to and outside a running rail, and each having one base side inserted into the slits of a set of braces, wherein each guard rail top is positioned above and outside the top of an adjacent running rail; and a plurality of cap screws bolted through the guard rail webs into the brace tops.

4. A car retarder as recited in claim 3, wherein said spring means is comprised of:

two coiled springs of thick wires and large diameters positioned between each bracket and the nearest friction rail, each spring having an inner end reaching to and contacting the bracket part and an outer end contacting the friction rail and its inner fitting.

5. A car retarder as recited in claim 4, wherein:

the inner friction rail fitting has lateral walls extending downward to bear on the surface of the gauge plates, on either side of a riser block, said inner friction rail fitting lateral walls functioning as rail braces to prevent the braking rail from tipping inward under the pressure from a railway car wheel.

6. A car retarder as recited in claim 5, wherein:

said friction rail inner fitting lateral walls also provide a recess for receiving said spring ends.

7. A car retarder as recited in claim 6, wherein said spring means is further comprised of:

a plurality of smaller springs similarly located between said brackets and friction rail within or beside the large diameter springs, wherein a spring surrounds each bolt, and a spring is nested within the coils of each large diameter spring.

8. A car retarder as recited in claim 7, further comprising:

a plurality of members with bores;

a plurality of hooked rod members passing through the bores of the members and gripping the bracket ledges;

a plurality of jaw members gripping the outside edge of the running rail base of each rail;

a plurality of nuts screwed on the ends of the hook rod members and holding the jaw members in gripping positions with the hook end of the rods; and a plurality of rod members running between jaw members and through the bores of the members in opposing brackets.

9. A car retarder as recited in claim 8, further comprising:

a replaceable face plate bolted to each friction rail, the outer side of the head of the friction rail being planed down on one side to be flat with the web of the rail and a length of steel bar, or other friction material, bolted in its place.

10. A car retarder as recited in claim 1, further comprising:

powered release means for releasing the spring pressure on said friction rails.

11. A car retarder as recited in claim 10, wherein:

said powered release means for releasing the spring pressure on said friction rails is comprised of a fluid cylinder attached to at least one bracket elongated part in each pair of brackets and said spring bolt extending toward said track center line, said cylinder having a piston therein extendable toward the said track center line, whereby fluid under pressure admitted to said cylinder is effective to extend the piston, thereby pulling said spring bolt and consequently said attached friction rail away from an adjacent running rail to a car wheel releasing position.

12. A car retarder as recited in claim 11, wherein:

said fluid cylinders are hollow, and the spring bolt which attaches to the said friction rail, passes through a hollow core piston and is constrained at its inner end by lock nuts, said cylinder being adapted so that as fluid forces the piston toward the track center line the spring bolt moves with it, pulling the friction rail inward toward the track center line.

13. A car retarder as recited in claim 12, wherein:

said cylinder is mounted against the back of the bracket elongated part which is bolted to the gauge plates through the foot plates which pass under the riser block inward lip and are locked by a lock pin passing through holes in the lip and underlying plate.

14. A car retarder as recited in claim 13, wherein said means for releasing the spring pressure on said friction rails is further comprised of:

fluid distributed from a pump via a pipe manifold and flexible hoses connected to each cylinder.

15. A car retarder as recited in claim 14, wherein:

each spring bolt moves freely through the hollow piston of the fluid cylinder.

16. A car retarder as recited in claim 15, wherein said means for releasing the spring pressure on said friction rails is further comprised of:

said fluid cylinder slidably positioned over the spring bolt abutting the back of the bracket elongated part;

a clamp positioned about said fluid cylinder; and two springs each having two ends, one end of which is attached to bolts affixed to the back of the bracket elongated part, the other end of each spring being attached to opposite sides of the clamp.

17. A car retarder as recited in claim 16, further comprising:

a stop rod positioned inside each large diameter spring adapted to cause pressure to suddenly spike when the fluid release reaches the end of its stroke, wherein the spike is used to signal the pumps and valves that the retarder is released and to stop pumping.

18. A car retarder as recited in claim 17, further comprising:

a plurality sensors located in the track bed or along the track to determine car position and/or speed to operate the release.

19. A car retarder as recited in claim 18, wherein:

said sensors are radar based sensors.

20. A car retarder as recited in claim 18, wherein:

said sensors are mechanical.

21. A car sensor as recited in claim 18, wherein:

said sensors are electromagnetic.

22. A car retarder as recited in claim 18, further comprising:

a plurality electronic controls adapted for controlling said fluid cylinders and linking their functions to car speed and spacing and other car-handling requirements.

23. A car retarder as recited in claim 22, wherein:

said electronic controls sequentially release said fluid cylinders to match car speed and/or position.

24. A car retarder as recited in claim 22, wherein:

said electronic controls proportionally release said fluid cylinders as a function of car speed and/or position.

25. A car retarder as recited in claim 22, wherein:

said electronic controls pulse on and off said fluid cylinders with a pulse duty cycle proportional to the energy absorbed by the retarder.

26. A car retarder as recited in claim 22, wherein:

said electronic controls release all said fluid cylinders wherein the moment of release is controlled by the car's speed or position in the retarder.

27. A car retarder as recited in claim 22 further comprising:

an external guard rail assembly positioned adjacent the outside edge of each running rail.

28. A car retarder as recited in claim 27 wherein each said external guard rail assembly is comprised of:

two sets of braces fixedly attached at and to each end of a gauge plate and bearing against the outside edge of the running rail base on each side, said braces having a top with a slit formed therein parallel to the running rails, each said set being positioned outside a running rail;

two guard rails, each with a web, a top and a base with two sides, and each of which positioned in a generally horizontal plane, parallel to and outside a running rail, and each having one base side inserted into the slits of a set of braces, wherein each guard rail top is positioned above and outside the top of an adjacent running rail; and a plurality of cap screws bolted through the guard rail webs into the brace tops.

29. A car retarder as recited in claim 28, further comprising:

a replaceable face plate bolted to each friction rail, the outer side of the head of the friction rail being planed down on one side to be flat with the web of the rail and a length of steel bar, or other friction material, bolted in its place.

30. A car retarder as recited in claim 29, further comprising:

a cover over the retarder assembly, spanning the space between the friction rails:

said pump mounted on ties adjacent to the retarder in a weather proof housing.

31. A car retarder as recited in claim 10, wherein said powered means for releasing the spring pressure on said friction rails is further comprised of:

a single said fluid cylinder interconnecting opposing spring bolts wherein retraction of the piston within said cylinder pulls opposite friction rails inward, toward each other; and a slip joint interposed in one of the opposing spring bolts thereby permits the retarder to function as an inert retarder, using its spring resistance to stop cars, without impedance from the fluid cylinder, said slip joint being effective in transmitting fluid power to pull the friction rails inward but falling slack when pushed by the inward movement of the friction rails.

32. A car retarder as recited in claim 31, further comprising:

a stop rod positioned inside each large diameter spring adapted to cause pressure to suddenly spike when the fluid release reaches the end of its stroke, wherein the spike is used to signal the pumps and valves that the retarder is released and to stop pumping.

33. A car retarder as recited in claim 32, wherein said means for releasing the spring pressure on said friction rails is further comprised of:

fluid distributed from a pump via a pipe manifold and flexible hoses connected to each cylinder.

34. A car retarder as recited in claim 33, further comprising:

a plurality sensors located in the track bed or along the track to determine car position and/or speed to operate the release.

35. A car retarder as recited in claim 34, further comprising:

a plurality electronic controls adapted for controlling said fluid cylinders and linking their functions to car speed and spacing and other car handling requirements.

36. A car retarder as recited in claim 35, wherein:

said electronic controls sequentially release said fluid cylinders to match car speed and/or position 37. A car retarder as recited in claim 35, wherein:

said electronic controls proportionally release said fluid cylinders as a function of car speed and/or position.

38. A car retarder as recited in claim 35, wherein:

said electronic controls pulse on and off said fluid cylinders with a pulse duty cycle proportional to the energy absorbed by the retarder.

39. A car retarder as recited in claim 35, wherein:

said electronic controls release all said fluid cylinders wherein the moment of release is controlled by the car's speed or position in the retarder.

40. A car retarder as recited in claim 35 further comprising:

an external guard rail assembly positioned adjacent the outside edge of each running rail.

41. A car retarder as recited in claim 40 wherein each said external guard rail assembly is comprised of:

two sets of braces fixedly attached at and to each end of a gauge plate and bearing against the outside edge of the running rail base on each side, said braces having a top with a slit formed therein parallel to the running rails, each said set being positioned outside a running rail;

two guard rails, each with a web, a top and a base with two sides, and each of which positioned in a generally horizontal plane, parallel to and outside a running rail, and each having one base side inserted into the slits of a set of braces, wherein each guard rail top is positioned above and outside the top of an adjacent running rail; and a plurality of cap screws bolted through the guard rail webs into the brace tops.

42. A car retarder as recited in claim 41, further comprising:

a replaceable face plate bolted to each friction rail, the outer side of the head of the friction rail being planed down on one side to be flat with the web of the rail and a length of steel bar, or other friction material, bolted in its place.

43. A car retarder as recited in claim 42, further comprising:

a cover over the retarder assembly, spanning the space between the friction rails;

said pump mounted on ties adjacent to the retarder in a weather proof housing.

44. A car retarder as recited in claim 10, wherein said powered means for releasing the spring pressure on said friction rails is comprised of:

a plurality of direct mechanical linkages between the opposed friction rails;

a retracting fluid cylinder interposed within each said linkage; and a slip joint interposed in each mechanical linkage, effective to transmit cylinder fluid power to pull the friction rails inward but falling slack when pushed by the inward movement of the friction rails.

45. A car retarder as recited in claim 44, wherein said means for releasing the spring pressure on said friction rails is further comprised of:

fluid distributed from a pump via a pipe manifold and flexible hoses connected to each cylinder.

46. A car retarder as recited in claim 45, further comprising:

a plurality sensors located in the track bed or along the track to determine car position and/or speed to operate the release.

47. A car retarder as recited in claim 46, further comprising:

a plurality electronic controls adapted for controlling said fluid cylinders and linking their functions to car speed and spacing and other car handling requirements.

48. A car retarder as recited in claim 47, wherein:

said electronic controls sequentially release said fluid cylinders to match car speed and/or position.

49. A car retarder as recited in claim 47, wherein:

said electronic controls proportionally release said fluid cylinders as a function of car speed and/or position.

50. A car retarder as recited in claim 47, wherein:

said electronic controls pulse on and off said fluid cylinders with a pulse duty cycle proportional to the energy absorbed by the retarder.

51. A car retarder as recited in claim 47, wherein:

said electronic controls release all said fluid cylinders wherein the moment of release is controlled by the car's speed or position in the retarder.

52. A car retarder as recited in claim 47 further comprising:

an external guard rail assembly positioned adjacent the outside edge of each running rail.

53. A car retarder as recited in claim 52 wherein each said external guard rail assembly is comprised of:

two sets of braces fixedly attached at and to each end of a gauge plate and bearing against the outside edge of the running rail base on each side, said braces having a top with a slit formed therein parallel to the running rails, each said set being positioned outside a running rail;

two guard rails, each with a web, a top and a base with two sides, and each of which positioned in a generally horizontal plane, parallel to and outside a running rail, and each having one base side inserted into the slits of a set of braces, wherein each guard rail top is positioned above and outside the top of an adjacent running rail; and a plurality of cap screws bolted through the guard rail webs into the brace tops.

54. A car retarder as recited in claim 53, further comprising:

a replaceable face plate bolted to each friction rail, the outer side of the head of the friction rail being planed down on one side to be flat with the web of the rail and a length of steel bar, or other friction material, bolted in its place.

55. A car retarder as recited in claim 54, further comprising:

a cover over the retarder assembly, spanning the space between the friction rails:

said pump mounted on ties adjacent to the retarder in a weather proof housing.

56. An improved car retarder assembly for a railway track with a center line and having ties and a pair of parallel running rails, each rail having a base, an inside edge facing the opposite running rail and an outside edge facing away from the opposite running rail, said retarder comprising:

a metallic gauge plate overlying and permanently affixed to each of the ties, said plate extending under the running rails on both sides of the track;

two riser blocks positioned to bear against the inside edge of the running rail base and fixedly attached to one of said gauge plates, each said riser block having an inward lip;

a plurality of brackets arranged in pairs, each pair comprising two brackets extending between a pair of neighboring ties, at opposite sides of the track center line, each of said brackets having foot plates overlying neighboring gauge plates and each foot plate having holes, each of said brackets having an elongated part with a back facing said track center line, said elongated part extending in secured position parallel to said running rails, said elongated part, having a top and a bottom, extending over a space between two neighboring ties and being recessed at the side opposite to the track center whereby the bracket forms a housing, a ledge extending from the bottom of the elongated part toward the track center line, two vertical sides, and said foot plates extending horizontally to both sides away from said vertical walls, said gauge plates having tapped holes formed therein to accommodate cap screws which pass through the holes of the foot plates and the tapped holes in the gauge plates;

a plurality of cap screws passing through said holes in said foot plates and into tapped holes in said gauge plates to secure said brackets to said gauge plates;

a pair of friction rails, one active and one passive, each having an outside portion of its foot cut off and each overlying and slidably resting on said riser blocks within the pair of running rails, one rail of the pair of friction rails extending parallel to the elongated part of one bracket of said bracket pair, and between the one bracket and one of the running rails, and the other rail of the pair of friction rails extending parallel to the elongated part of the other bracket of said bracket pair, and between the other bracket and the other rail of the running rails;

spring means engaging the active friction rail and an adjacent one of said brackets to yieldably urge the active friction rail to slide toward an adjacent one of the running rails;

a brace means engaging the passive friction rail and an adjacent bracket part to hold the passive friction rail a fixed distance from its adjacent bracket;

connecting means between each bracket and an adjacent one of the friction rails to limit the movement of the adjacent friction rail toward an adjacent one of the running rails;

a hooked rod member attached by an adjustable nut to the base of one of said running rails, said rod member running underneath the friction rail and the bracket adjacent to said one of said running rails and underneath said one of said running rails and terminating in a hook member to grip an edge of said ledge of the adjacent bracket;

two shoulder blocks fixedly attached at and to the ends of one of said gauge plates and bearing against the outside edges of the running rail bases;

wherein, said active friction rail is fitted with stop bolts and web fittings, said stop bolts each having an end in contact with an adjacent one of the running rails, thereby limiting the movement of the active friction rail towards the adjacent running rail.

57. A car retarder as recited in claim 56 further comprising:

an external guard rail assembly positioned adjacent the outside edge of each running rail.

58. A car retarder as recited in claim 57 wherein each said external guard rail assembly is comprised of:

two sets of braces fixedly attached at and to each end of a gauge plate and bearing against the outside edge of the running rail base on each side, said braces having a top with a slit formed therein parallel to the running rails, each said set being positioned outside a running rail;

two guard rails, each with a web, a top and a base with two sides, and each of which positioned in a generally horizontal plane, parallel to and outside a running rail, and each having one base side inserted into the slits of a set of braces, wherein each guard rail top is positioned above and outside the top of an adjacent running rail; and a plurality of cap screws bolted through the guard rail webs into the brace tops.

59. A car retarder as recited in claim 58, further comprising:

a replaceable face plate bolted to each friction rail, the outer side of the head of the friction rail being planed down on one side to be flat with the web of the rail and a length of steel bar, or other friction material, bolted in its place.

60. A car retarder as recited in claim 56, further comprising:

powered release means for releasing the spring pressure on said active rail.

61. A car retarder as recited in claim 60, wherein:

said powered release means is comprised of a fluid cylinder attached to each bracket elongated part in each bracket adjacent to said active friction rail and said spring bolt extending toward said track center line, said cylinder having a piston therein extendable toward the said track center line, whereby fluid under pressure admitted to said cylinder is effective to extend the piston, thereby pulling said spring bolt and consequently said attached active friction rail away from an adjacent running rail to a car wheel releasing position.

62. A car retarder as recited in claim 61, further comprising:

a stop rod positioned inside each large diameter spring adapted to cause pressure to suddenly spike when the fluid release reaches the end of its stroke, wherein the spike is used to signal the pumps and valves that the retarder is released and to stop pumping.

63. A car retarder as recited in claim 62, wherein said means for releasing the spring pressure on said friction rails is further comprised of:

fluid distributed from a pump via a pipe manifold and flexible hoses connected to each cylinder.

64. A car retarder as recited in claim 63, further comprising:

a plurality sensors located in the track bed or along the track to determine car position and/or speed to operate the release.

65. A car retarder as recited in claim 64, further comprising:

a plurality electronic controls adapted for controlling said fluid cylinders and linking their functions to car speed and spacing and other car handling requirements.

66. A car retarder as recited in claim 65, wherein:

said electronic controls sequentially release said fluid cylinders to match car speed and/or position.

67. A car retarder as recited in claim 65, wherein:

said electronic controls proportionally release said fluid cylinders as a function of car speed and/or position.

68. A car retarder as recited in claim 65, wherein:

said electronic controls pulse on and off said fluid cylinders with a pulse duty cycle proportional to the energy absorbed by the retarder.

69. A car retarder as recited in claim 65, wherein:

said electronic controls release all said fluid cylinders wherein the moment of release is controlled by the car's speed or position in the retarder.

70. A car retarder as recited in claim 65 further comprising:

an external guard rail assembly positioned adjacent the outside edge of each running rail.

71. A car retarder as recited in claim 70 wherein each said external guard rail assembly is comprised of:

two sets of braces fixedly attached at and to each end of a gauge plate and bearing against the outside edge of the running rail base on each side, said braces having a top with a slit formed therein parallel to the running rails, each said set being positioned outside a running rail;

two guard rails, each with a web, a top and a base with two sides, and each of which positioned in a generally horizontal plane, parallel to and outside a running rail, and each having one base side inserted into the slits of a set of braces, wherein each guard rail top is positioned above and outside the top of an adjacent running rail; and a plurality of cap screws bolted through the guard rail webs into the brace tops.

72. A car retarder as recited in claim 71, further comprising:

a replaceable face plate bolted to each friction rail, the outer side of the head of the friction rail being planed down on one side to be flat with the web of the rail and a length of steel bar, or other friction material, bolted in its place.

73. A car retarder as recited in claim 72, further comprising:

a cover over the retarder assembly, spanning the space between the friction rails:

said pump mounted on ties adjacent to the retarder in a weather proof housing.

74. A car retarder as recited in claim 56, further comprising:

a powered releasing mechanism attached to said passive friction rail adapted to move said passive friction rail closer to the active friction rail thereby removing the friction force.

75. A car retarder as recited in claim 74, wherein:

said powered releasing mechanism is comprised of a fluid powered cylinder.

76. A car retarder as recited in claim 75, wherein said means for releasing the friction force on said friction rails is further comprised of:

fluid distributed from a pump via a pipe manifold and flexible hoses connected to each cylinder.

77. A car retarder as recited in claim 76, further comprising:

a plurality sensors located in the track bed or along the track to determine car position and/or speed to operate the release.

78. A car retarder as recited in claim 77, further comprising:

a plurality electronic controls adapted for controlling said fluid cylinders and linking their functions to car speed and spacing and other car handling requirements.

79. A car retarder as recited in claim 78, wherein:

said electronic controls sequentially release said fluid cylinders to match car speed and/or position.

80. A car retarder as recited in claim 78, wherein:

said electronic controls proportionally release said fluid cylinders as a function of car speed and/or position.

81. A car retarder as recited in claim 78, wherein:

said electronic controls pulse on and off said fluid cylinders with a pulse duty cycle proportional to the energy absorbed by the retarder.

82. A car retarder as recited in claim 78, wherein:

said electronic controls release all said fluid cylinders wherein the moment of release is controlled by the car's speed or position in the retarder.

83. A car retarder as recited in claim 78 further comprising:

an external guard rail assembly positioned adjacent the outside edge of each running rail.

84. A car retarder as recited in claim 83 wherein each said external guard rail assembly is comprised of:

two sets of braces welded fixedly attached at and to each end of a gauge plate and bearing against the outside edge of the running rail base on each side, said braces having a top with a slit formed therein parallel to the running rails, each said set being positioned outside a running rail;

two guard rails, each with a web, a top and a base with two sides, and each of which positioned in a generally horizontal plane, parallel to and outside a running rail, and each having one base side inserted into the slits of a set of braces, wherein each guard rail top is positioned above and outside the top of an adjacent running rail; and a plurality of cap screws bolted through the guard rail webs into the brace tops.

85. A car retarder as recited in claim 84, further comprising:

a replaceable face plate bolted to each friction rail, the outer side of the head of the friction rail being planed down on one side to be flat with the web of the rail and a length of steel bar, or other friction material, bolted in its place.

86. A car retarder as recited in claim 85, further comprising:

a cover over the retarder assembly, spanning the space between the friction rails:

said pump mounted on ties adjacent to the retarder in a weather proof housing.

* * * * *